US009440276B2

(12) United States Patent
Schröer

(10) Patent No.: US 9,440,276 B2
(45) Date of Patent: Sep. 13, 2016

(54) EXHAUST GAS MUFFLER FOR INTERNAL COMBUSTION ENGINES AND DEEP DRAWING TOOL THEREFOR

(75) Inventor: Klaus Schröer, Landau (DE)

(73) Assignee: Tenneco GmbH, Edenkoben (DE)

( * ) Notice: Subject to any disclaimer, the term of this patent is extended or adjusted under 35 U.S.C. 154(b) by 489 days.

(21) Appl. No.: 13/697,956

(22) PCT Filed: May 17, 2011

(86) PCT No.: PCT/EP2011/057983
§ 371 (c)(1),
(2), (4) Date: Nov. 14, 2012

(87) PCT Pub. No.: WO2011/144621
PCT Pub. Date: Nov. 24, 2011

(65) Prior Publication Data

US 2013/0056298 A1 Mar. 7, 2013

(30) Foreign Application Priority Data

May 18, 2010 (DE) ..... 10 2010 020 826

(51) Int. Cl.
*B21D 22/26* (2006.01)
*B21D 51/18* (2006.01)
(Continued)

(52) U.S. Cl.
CPC ..... *B21D 22/20* (2013.01); *B21D 22/26* (2013.01); *B21D 51/18* (2013.01); *B21D 53/88* (2013.01);
(Continued)

(58) Field of Classification Search
CPC .. B21D 22/20; B21D 22/201; B21D 22/203; B21D 22/206; B21D 22/21; B21D 22/26; B21D 37/02; B21D 37/08; B21D 51/16; B21D 51/18; B21D 51/38; B21D 53/84; B21D 53/88; B21D 24/00; F01N 13/007; F01N 13/18; F01N 13/1872; F01N 13/1888; F01N 13/1894; F01N 2260/18; F01N 2260/20; F01N 2340/00; F01N 2490/16; F01N 2490/18; F01N 13/002; F01N 3/02; F04C 29/06; F04C 29/065; Y10T 29/49398
See application file for complete search history.

(56) References Cited

U.S. PATENT DOCUMENTS
3,263,637 A * 8/1966 Cox ..... 72/347
3,568,254 A * 3/1971 Stolki ..... 425/388
(Continued)

FOREIGN PATENT DOCUMENTS
CA 2058136 C 7/1995
DE 19849118 A1 4/2000
(Continued)

*Primary Examiner* — Christopher Besler
*Assistant Examiner* — Matthew P Travers
(74) *Attorney, Agent, or Firm* — Hudak, Shunk & Farine, Co. LPA

(57) ABSTRACT

A shell muffler for an internal combustion engine that is formed of a first shell and at least one second shell, which shells are connected at their respective edge regions $B_S$ so as to form the shell muffler, each edge region $B_S$ having a box-like inner contour $K_{Si}$, which has four corner regions (E1)-(E4) and a width (B) and a length (L), and an outer contour $K_{Sa}$, and each shell being produced from a shell blank R, which is formed by deforming a sheet metal strip using a deep drawing tool having the shape of the shell, the blank R, after deforming, having an edge region $B_R$ with an outer contour $K_R$, said edge region being removed at least partially after the blank R has been cut to size so as to form the outer contour $K_{Sa}$ of the edge region $B_S$ of the shell. In addition to the box-like basic shape G, the inner contour $K_{Si}$ of the edge region $B_S$ of the shell has at least one corner region (E1-E4) which is expanded beyond the width B and the length L of the box-like basic shape (G) and is thus adapted at least partially to the contour $K_R$ of the edge region $B_R$ to be cut of the blank R.

8 Claims, 3 Drawing Sheets

(51) Int. Cl.

| | |
|---|---|
| ***F01N 13/18*** | (2010.01) |
| ***B21D 53/88*** | (2006.01) |
| ***B21D 22/20*** | (2006.01) |
| *B21D 22/22* | (2006.01) |

(52) U.S. Cl.
CPC ..... *F01N 13/1872* (2013.01); *B21D 22/22* (2013.01); *F01N 13/1861* (2013.01); *F01N 13/1888* (2013.01); *F01N 13/1894* (2013.01)

(56) References Cited

U.S. PATENT DOCUMENTS

| | | | | |
|---|---|---|---|---|
| 3,638,756 | A * | 2/1972 | Thiele | 181/245 |
| 4,309,888 | A * | 1/1982 | Miller et al. | 72/334 |
| 4,836,330 | A * | 6/1989 | Harwood et al. | 181/282 |
| 4,865,154 | A * | 9/1989 | Hanson et al. | 181/282 |
| 4,905,791 | A * | 3/1990 | Garey | 181/282 |
| 4,909,348 | A * | 3/1990 | Harwood et al. | 181/282 |
| 5,004,069 | A * | 4/1991 | Van Blaircum et al. | 181/282 |
| 5,020,631 | A | 6/1991 | DeVille | |
| 5,164,551 | A | 11/1992 | Harwood et al. | |
| 5,428,194 | A * | 6/1995 | Emrick et al. | 181/228 |
| 5,448,831 | A * | 9/1995 | Harwood | 29/890.08 |
| 5,949,035 | A * | 9/1999 | Herold | 181/282 |
| 5,959,262 | A * | 9/1999 | Menzel | 181/231 |
| 6,041,890 | A * | 3/2000 | Wolf et al. | 181/230 |
| 6,170,604 | B1 | 1/2001 | Menzel et al. | |
| 6,931,367 | B2 | 8/2005 | Harwood | |
| 7,669,694 | B2 * | 3/2010 | Seon | 181/269 |
| 7,854,296 | B2 * | 12/2010 | Saunders et al. | 181/240 |

FOREIGN PATENT DOCUMENTS

| | | | |
|---|---|---|---|
| DE | 202008016200 | U1 | 3/2009 |
| EP | 0395540 | A1 | 10/1990 |
| EP | 1316462 | A1 | 6/2003 |

* cited by examiner

D – from Fig. 2a

EXHAUST GAS MUFFLER FOR INTERNAL COMBUSTION ENGINES AND DEEP DRAWING TOOL THEREFOR

FIELD OF THE INVENTION

The invention relates to a shell muffler for an internal combustion engine, formed of a first shell and at least one second shell, which are connected at their circumferential edge regions $B_S$ in order to form the shell muffler, each edge region $B_S$ having a box-shaped inner contour $K_{Si}$, which has four corner regions E1-E4 and a width B and a length L, and an outer contour $K_{Sa}$, and each shell being produced from a shell blank R, which is formed by shaping a sheet metal strip by means of a deep drawing tool having the shape of the shell, the shaped blank R having an edge region $B_R$, which has an outer contour $K_R$ and is cut off at least partly once the blank R has been cut to size in or to form an outer contour $K_{Sa}$ of the edge region $B_S$ of the shell.

BACKGROUND OF THE INVENTION

An exhaust gas muffler that is formed of a pair of shaped shells is already known from CA 2,058,136, wherein an edge surface of the two shaped shells is folded in order to connect them. Additional tongues are provided in the region of the edge surface and serve to mount a heat shield. Said tongues are placed in excess regions of each shaped shell, which would otherwise be cut off when the shell is cut to size.

DE 20 2008 016 200 U1 describes a two-piece muffler whose basic shape includes two corner regions each of which extends beyond the length of said basic shape. In terms of width, however, the corner regions are smaller than the basic shape. However, this design does not allow for optimum utilization of the sheet metal strips that are to be shaped.

SUMMARY OF THE INVENTION

The object of the invention is to design and arrange an exhaust gas muffler made of shaped shells and a deep drawing tool for the production of a shaped shell such as to ensure material savings and an improved acoustic performance.

According to the invention, this object is achieved by providing the inner contour $K_{Si}$ of the edge region $B_S$ of the shell with at least one corner region E1-E4 in addition to the box-like basic shape C, which corner region extends beyond the width B and the length L, thus being at least partly adapted to the outer contour $K_R$ of the edge region $B_R$ of the blank R that needs to be cut to size. This serves to achieve a more uniform overall shape of the edge region $B_R$ of the blank that needs to be cut off in order to form the inner and/or outer contour $K_{Si}$, $K_{Sa}$ of the shell, resulting in material savings. In addition, the overall volume of each shell can be increased by utilizing the volumes of these corners. If the volume is increased in this way, the width and/or length of the shell as a whole can be made smaller while the volume remains the same, thus achieving further material savings, in case the width of the shell is reduced, as described above, the sheet metal strip used for deep drawing or the relevant coil can also be narrower.

If said corner regions of the edge region $B_R$ of the blank are utilized, the inner and/or outer contour $K_{Si}$ and/or $K_{Sa}$ of the shell or the edge region $B_S$ obtained also differ(s) from the usual box-like basic shape G, resulting in favourable resonance characteristics or a favourable acoustic performance.

Furthermore, the object of the invention is achieved by providing each shell with a raised portion A in order to form a dome-shaped inlet or outlet for connection of an exhaust gas pipe, wherein said raised portion A, once shaped, protrudes by a depth t1 relative to the basic shape G of the inner contour $K_{Si}$ of the edge region $B_S$ of the shell, which depth t1 is selected such that, in order to form the raised portion A, the size of the sheet metal strip need not be selected larger than in case said raised portion A is omitted, and/or a sunken portion E is provided in the region of the raised portion A, which sunken portion E is provided in addition to the waist T and is placed further back by a depth t2 relative to the basic shape G of the inner contour $K_{Si}$ of the edge region $B_S$ of the shell. As a rule, each shell includes the raised portion A for a dome-shaped inlet or outlet at least in the region of a longitudinal or transverse edge. The aforesaid features relating to the maximum depth t1 of said raised portion A ensure the savings described above with regard to the width and/or length of the sheet metal strip used. Due to the sunken portion E provided according to the invention, a raised portion A of a desired height h can be formed. Said sunken portion E allows for an increase in the size or height h of the raised portion A beyond the waist T of the basic shape G. Insofar, the sunken portion E is provided in addition to the waist T according to the definition of the invention. The height h of the raised portion A can have a total depth of t1 plus t2. Once the shell is cut to size, the depth t1 is reduced and can even become zero in case the raised portion is cut to the height of the inner contour $K_{Si}$.

For this purpose, it can also be advantageous if the shape of the outer contour $K_{Sa}$ differs from the inner contour $K_{Si}$. Preferably, the inner contour $K_{Si}$ and the outer contour $K_{Sa}$ are the same. However, the outer contour $K_{Sa}$ can be made even wider than the inner contour $K_{Si}$ to adapt it to the contour $K_R$ of the blank or the corner regions thereof, thus improving the acoustic performance.

Furthermore, it can be advantageous if the inner contour $K_{Si}$ and/or the outer contour $K_{Sa}$ of the edge region $B_S$ of the shell is/are formed of a first longitudinal edge L1, a second longitudinal edge L2, a first transverse edge Q1 and a second transverse edge Q2 as well as of the four corner regions E1, E2, E3, E4, wherein each corner region E1, E2, E3, E4 connects a longitudinal edge L1, L2 to a transverse edge Q1, Q2 and the edge region $B_S$ of the shell includes a waist T at least in the region of a longitudinal edge L1, L2 and/or a transverse edge Q1, Q2, which waist extends across at least 50% to 80% of a length w1 and/or a width w2 of the shell. Based on a usual contour $K_R$ of a blank, which projects much more beyond the desired basic shape G in the region of each corner of the shell to be formed than in the region between the corners, it is advantageous to select a shape including a waist T. As a result of such a waist, the shell is narrower and/or shorter in the region of the waist than in the region of each corner at the beginning and end of said waist. Depending on the relevant radius of the corner, the upper limit of the waist is to be assumed in the range from 90% to 95%. In case of a 100% waist, there is no waist any more.

It can also be advantageous if the inner contour $K_{Si}$ and/or the outer contour $K_{Sa}$ of the edge region $B_S$ of the shell include(s) the waist T in the region of both longitudinal edges L1, L2 and/or in the region of both transverse edges Q1, Q2. The waist can be provided on different longitudinal and/or transverse edges, as desired. The decision to be made in this regard depends on the desired design and the resulting resonance characteristics on the one hand and the desired material savings on the other. It may be beneficial to provide the waist on both longitudinal as well as both transverse edges, so that the advantages mentioned above will add to each other for maximum advantage.

In this context, the inner contour $K_{Si}$ and/or the out contour $K_{Sa}$ of the edge region $B_S$ of the shell can advantageously define a bone-like basic shape G. A waist provided on all four longitudinal edges results in a bone-like basic shape G according to the exemplary embodiment, which, due to the wider corner regions, ensures the maximum volume described above while minimizing the width of the sheet metal strip used on the one hand and minimizing the length of the sheet metal strip used on the other.

The object of the invention is also achieved by means of a deep drawing tool with a basic shape G3 having an outer contour $K_W$, which serves to shape a sheet metal strip in order to form a blank R of a shell of a shell muffler of the type and shape described above, wherein said outer contour $K_W$ of the basic shape G3 of the deep drawing tool includes at least one corner region E1-E4, which extends beyond the width B and the length L, thus being adapted at least partly to the contour $K_R$ of the edge region $B_R$ of the blank R that needs to be cut to size. The advantages described above with regard to the acoustic performance and material savings of a shell or a shell muffler formed according to the invention are of course also achieved by a suitably designed deep drawing tool. The savings achieved in respect of the width and length of the deep drawing tool formed are also present, forming the basis of the essential advantages of the shell, which reside in the acoustic performance and savings on the part of the shell muffler, as discussed above.

Furthermore, the object of the invention is achieved by the fact that the outer contour $K_W$ of the basic shape G3 of the deep drawing tool includes a die designed to form a dome-shaped inlet or outlet for connection of an exhaust gas pipe, wherein said die protrudes by a depth t3, t3' relative to the basic shape G of the outer contour $K_W$, wherein said depth t3 is selected such that in order to form the raised portion A, the size of the sheet metal strip need not be selected larger than in case said raised portion A is omitted, and/or that a depression is provided in the region of the die, which depression is provided in addition to the waist T and is placed further back by a depth t4 relative to the basic shape G of the outer contour $K_W$. The die can therefore have a maximum depth of t3 plus t4, allowing a raised portion A of a desired height h to be formed.

The object of the invention is also achieved by means of methods for determining an inner and/or outer contour $K_{Si}$, $K_{Sa}$ of an edge region $B_S$ of a shell used to produce a muffler, comprising the method steps of:

a) deep drawing of a shell from a sheet metal strip using a deep drawing tool with a box-shaped outer contour $K_W$;

b) determining the outer contour $K_R$ of the deep drawn blank R;

c) widening of the corner regions E1-E4 of the deep drawing tool such that the outer contour $K_W$ becomes similar to the outer contour $K_R$;

d) repeating the method steps a) to c) at least once.

The fact that the outer and/or inner contour $K_{Sa}$, $K_{Si}$ is/are determined iteratively ensures that the desired contour is optimally formed.

BRIEF DESCRIPTION OF THE DRAWINGS

Further advantages and details of the invention are explained in the patent claims and in the description and are shown in the drawings, in which:

DETAILED DESCRIPTION OF THE INVENTION

Figure 1:
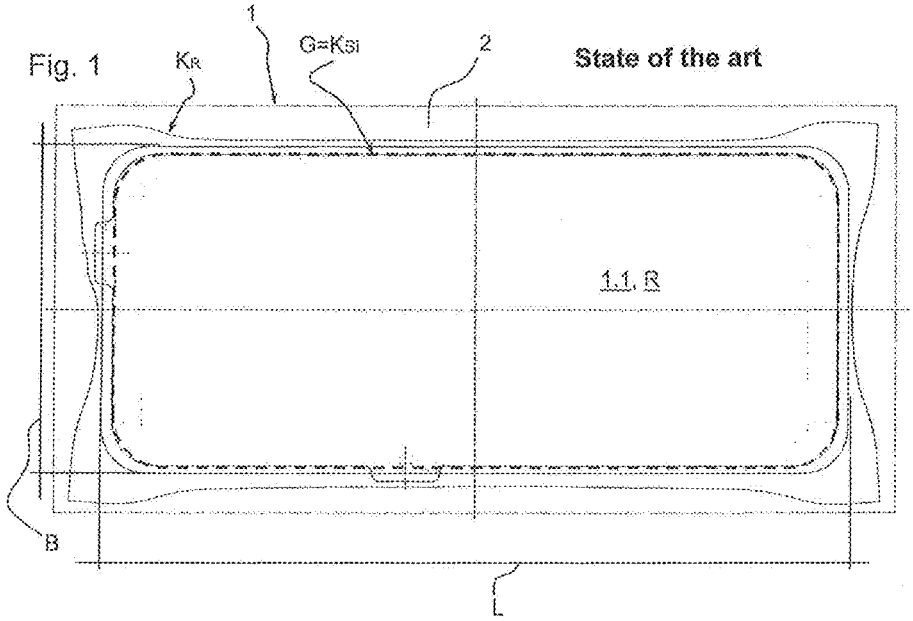
FIG. 1 shows a plan view of a shell according to the state of the art.

A first shell 1.1 of a shell muffler 1 according to the state of the art is formed by deep drawing of a sheet metal strip 2 that is rectangular in shape and is provided based on a sheet metal coil. First, a so-called blank R is obtained by deep drawing of a desired contour $K_S$ of the shell 1.1 with a basic shape G that is box-like, i.e. rectangular with rounded corners, according to FIG. 1; the edge of said blank has a contour $K_R$ differing from the rectangular shape of the sheet metal strip 2 on the one hand and from the desired box-shaped contour $K_S$ of the shell 1.1 on the other. The contour $K_R$ of the blank R is also referred to as bone-shaped since the remaining edge that needs to be cut off in order to form the contour $K_S$ or the outer contour $K_{Sa}$ of the shell 1.1 is much larger in the region of each corner than in the region between the corners.

Figure 2A:
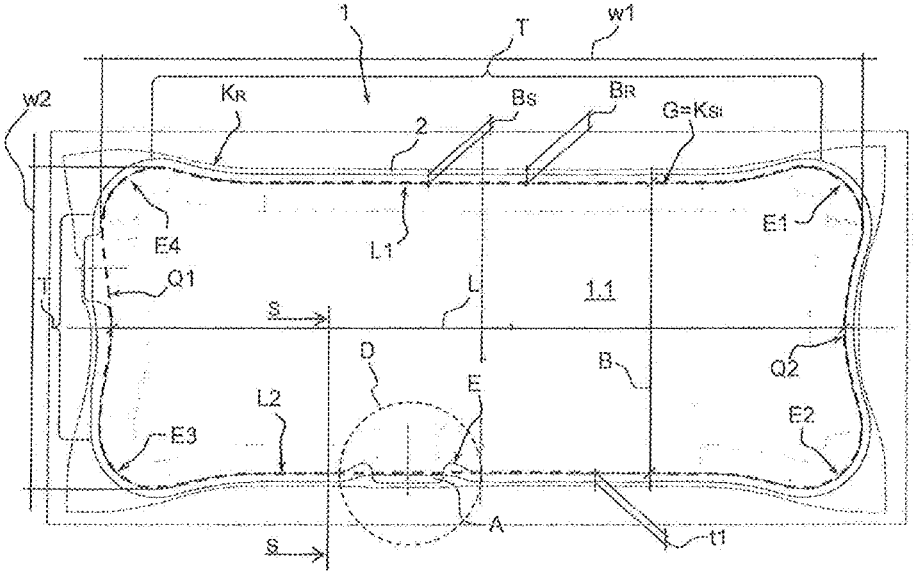
FIG. 2*a* shows a plan view of a shell according to the invention.

As shown in FIG. 2*a*, the contour $K_S$ according to the invention, i.e. the outer contour $K_{Sa}$ and the inner contour $K_{Si}$ of the shell 1.1, is adapted to the bone-shaped contour $K_R$ of the blank R. For this purpose, the shell 1.1 or the contour $K_S$ has a basic shape S whose corner regions E1-E4 extend beyond the width B and the length L, so that the contour $K_S$ is adapted at least partly to the contour $K_R$ of the edge region $B_R$ of the blank R that needs to be cut to size. The result are two opposite longitudinal edges L1, L2 and two opposite transverse edges Q1, Q2, which are connected to each other by a corner region E1, E2, E3, E4 in each case. The contour $K_S$ or the basic shape G includes a waist T between each of the corner regions E1 to E4. In the region of each waist T, the distance of the two longitudinal edges L1, L2 or the two transverse edges Q1, Q2 is smaller than a length w1 of the shell 1.1 or a width w2 of the shell 1.1. If each corner region E1 to E4 is widened such as to extend into the corner zone of an edge region $B_R$ of the blank R, an increase in the volume defined by the shell 1.1 on one side is achieved and the edge region $B_R$ of the blank R that needs to be cut off is made smaller. Said increase in volume allows the overall width w2 and/or the overall width w1 to be reduced while ensuring the same volume of each shell 1.1.

Figure 4:
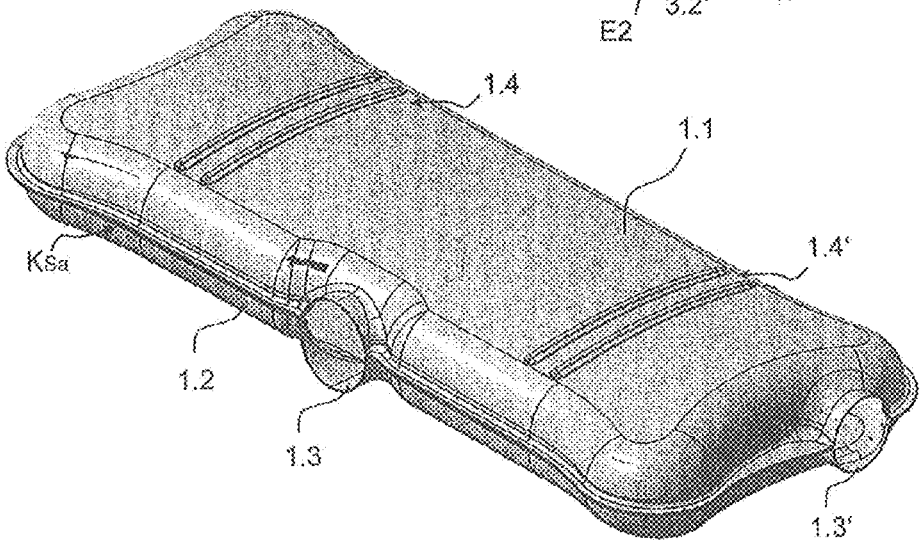
FIG. 4 shows a perspective view of a shell muffler.

The shell 1.1 shown here is provided with a raised portion A for a dome-shaped inlet or outlet 1.3 according to FIG. 4 in the region of its longitudinal edge L2. To form said raised portion A, a sunken portion E of a depth t2 is provided in the region of the raised portion A. Said sunken portion E is essentially formed of a rounding radius $V_R$1 and an adjoining connective portion $V_A$1. The sunken portion E is provided in addition to the waist T. The raised portion A extends across said rounding radius $V_R$1 and the adjoining connective portion $V_A$1 as well as an adjoining rounding radius $V_R$2 over a height h. Due to the sunken portion E, it only protrudes by a depth t1 beyond the bone-shaped inner contour $K_{Si}$ of the shell 1.1 in the region of the longitudinal edge L2. Said depth t1 is selected such that due to the raised portion A alone, the sheet metal strip 2 need not be selected wider than in case there is no raised portion A. This means, the depth t1 is approximately the same as the thickness of the edge region $B_S$ or the height of the rounding radius $V_R$2 adjoining the connective portion $V_A$1 and the rounding radius $V_R$1 of the raised portion A. As a result, the raised portion A ends approximately at the height of the outer contour $K_{Sa}$.

The waist T extends approximately across 84% of the length w1 and 66% of the width w2. In an exemplary embodiment not shown, said waist T may be provided only on a part of each longitudinal or transverse edge L1 to Q2.

Figure 2B:
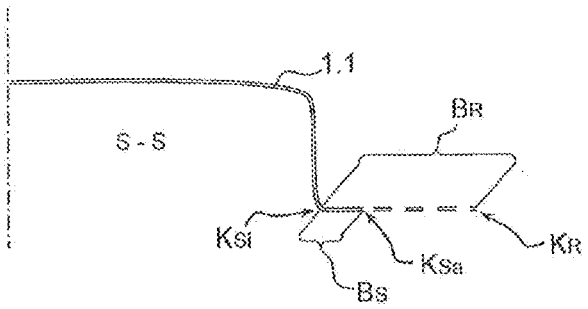
FIG. 2*b* shows a sectional view along S-S of FIG. 2*a;*

According to FIG. 2*b*, sectional view along S-S of FIG. 2*a* (partial section, right half), the shell 1.1 includes a remaining edge region $B_S$, which remains once the edge region $B_R$ of the blank R with the outer contour $K_R$ has been cut to size. In this edge region $B_S$, the shell 1.1 is connected to a corresponding second shell 1.2 according to FIG. 4. This can be done by welding or by means of a lock seam. Finally, the edge region $B_S$ has an inner contour $K_{Si}$ and an outer contour $K_{Sa}$, which are the same according to the exemplary embodiment shown in FIGS. 2*a*, 2*b*. In principle, the inner contour $K_{Si}$ may also be different from the outer contour $K_{Sa}$. To ensure a maximum volume according to the invention, the contour $K_S$ needs to be designed according to the invention at least in the region of the inner contour $K_{Si}$. This results in an at least similar size or widening of the outer contour $K_{Sa}$. The size or widening of the outer contour $K_{Sa}$ may also exceed that of the inner contour $K_{Si}$.

Figure 3:
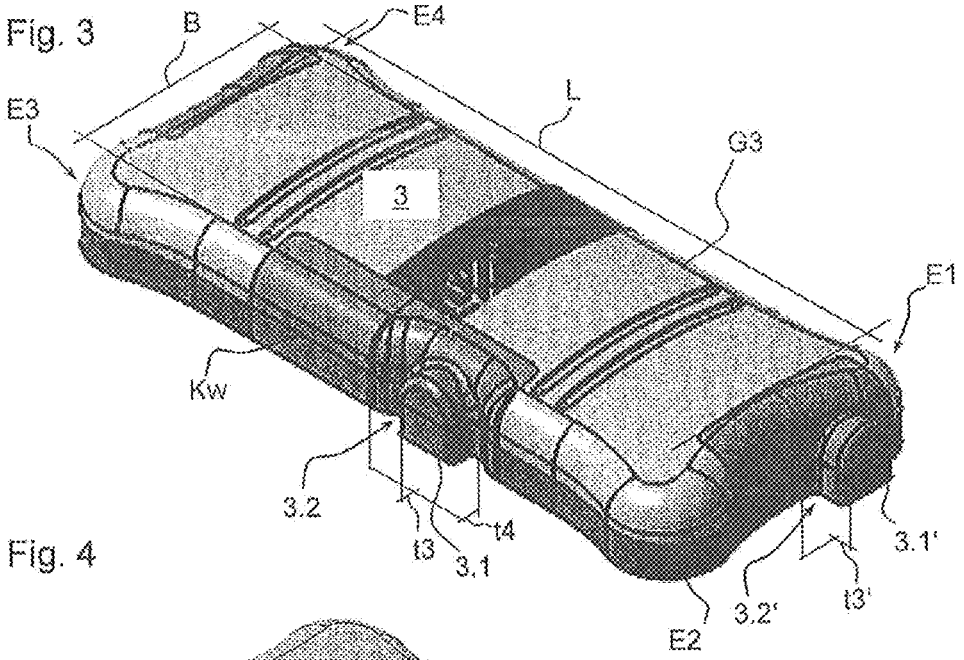
FIG. 3 shows a perspective view of a deep drawing tool.

A deep drawing tool 3 or drawing punch shown in FIG. 3 also has an outer contour $K_W$ with a bone-like basic shape G3 including four corner regions E1-E4. In addition, the deep drawing tool includes two dies 3.1, 3.1' for forming a desired raised portion A for a dome-shaped inlet or outlet 1.3 in the region of the longitudinal edge as well as in the region of the transverse edge. Said dies 3.1, 3.1' protrude by a depth t3, t3' beyond the outer contour $K_W$. The depth t3, t3' is selected such that the width of the sheet metal strip 2 provided is sufficient to form the raised portion A. Moreover, a depression 3.2, 3.2' is provided in the region of the die 3.1 in addition to the waist T, which depression 3.2, 3.2' is placed further back by a depth t4 relative to the basic shape G of the outer contour $K_W$. As a result, the die 3.1 protrudes by the depth t3 plus the depth t4 beyond the basic shape G of the outer contour $K_W$.

As shown in FIG. 4, the first shell 1.1 as well as the second shell 1.2 have the same, corresponding basic shape G or contour $K_{Si}$ which is designed or widened according to the normally remaining edge region $B_R$ or its contour $K_R$ of the blank R in the corner regions E1-E4, as shown in FIG. 2*a*. The two shells 1.1 and 1.2 are connected to each other in the edge region $B_S$, thus jointly defining twice the increased volume ensured by each shell. The bone-shaped design of the shell muffler 1 shown here also ensures the acoustic advantages described above. In addition, ribs 1.4, 1.4' are provided in the region of each shell, which improve the acoustic performance or resonance characteristics even further. Said ribs 1.4, 1.4' are approximately parallel to the transverse edge in each case. More than one set of ribs may be provided and, as an alternative, the ribs may also extend in other directions, in particular parallel to each longitudinal edge, in an exemplary embodiment not shown. The shells 1.1, 1.2 are cut to size, resulting in the outer contour $K_{Sa}$. The raised portion A is also cut to size, so that the depth t1 (not shown) is much smaller than immediately after shaping.

Figure 5:
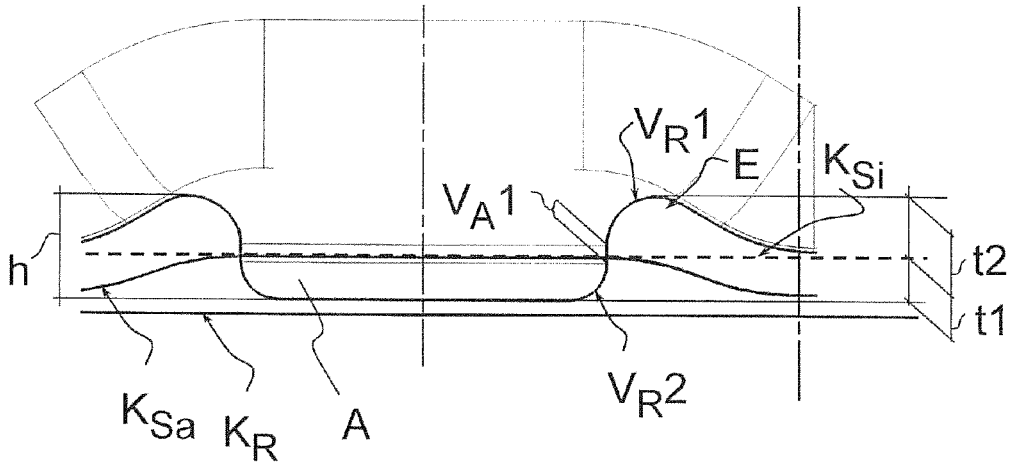
FIG. 5 shows the detailed view D to FIG. 2*a.*

FIG. 5 shows the detailed view D of FIG. 2*a*, which illustrates the raised portion A including the rounding radii $V_R$1, $V_R$2 and the connective portion $V_A$ between the inner contour $K_{Si}$ and the contour of the raised portion A. The height h of the raised portion A is the same as the two depths t1 and t2.

LIST OF REFERENCE NUMERALS

1 Shell muffler
1.1 First shell
1.2 Second shell
1.3 Dome-shaped inlet or outlet
1.4 Ribs
1.4' Ribs
2 Sheet metal strip
3 Deep drawing tool
3.1 Die for the dome-shaped inlet or outlet
3.1' Die for the dome-shaped inlet or outlet
3.2 Depression
3.2' Depression
A Raised portion
w1 Length
w2 Width
B Width
$B_R$ Edge region
$B_S$ Edge region
D Detailed view
E Sunken portion
E1 Corner region
E2 Corner region
E3 Corner region
E4 Corner region
G Basic shape
G3 Basic shape
h Height
$K_R$ Contour, blank
$K_{Si}$ Inner contour, shell
$K_{Sa}$ Outer contour, shell
$K_W$ Outer contour, deep drawing tool
L Length
L1 First longitudinal edge
L2 Second longitudinal edge
Q1 First transverse edge
Q2 Second transverse edge
R Shell blank
T Waist
t1 Depth
t2 Depth
$V_A$ Connective portion
$V_R$1 Rounding radius
$V_R$2 Rounding radius
w1 Width
w2 Width

What is claimed is:

1. A shell muffler for an internal combustion engine, comprising: a first shell and at least one second shell, which are connected at their edge regions ($B_S$) in order to form the shell muffler, each edge region ($B_S$) having a box-shaped inner contour ($K_{Si}$), which has four corner regions (E1-E4) and a width (B) and a length (L), and an outer contour ($K_{Sa}$), and each shell being produced from a shell blank (R), which is formed by shaping a sheet metal strip by a deep drawing tool having the shape of the shell, the shaped blank (R) having an edge region ($B_R$), which has an outer contour ($K_R$) and is removed at least partly once the blank (R) has been cut to size by applying the outer contour ($K_{Sa}$) and/or the inner contour ($K_{Si}$) determined by a) deep drawing of a shell from a sheet metal strip using a deep drawing tool with a box-shaped outer contour ($K_W$) to produce a blank (R);

b) determining the outer contour ($K_R$) of the deep drawn blank (R);

c) widening of at least one of the corner regions (E1-E4) of the deep drawing tool such that the outer contour ($K_W$) as well as the outer contour $K_{Sa}$ and/or the inner contour $K_{Si}$ which have/has to be produced becomes similar to the outer contour ($K_R$); and d) repeating the method steps a) to c) at least once in order to form the outer contour ($K_{Sa}$) of the edge region ($B_S$) of the shell, wherein in addition to a box-like basic shape (G), the inner contour ($K_{Si}$) of the edge region ($B_S$) of the shell is furnished with at least one corner region (E1-E4), which extends beyond the width (B) and the length (L) of the box-like basic shape (G), thus the inner contour ($K_{Si}$) being at least partly adapted to a contour ($K_R$) of the edge region ($B_R$) of the blank (R) that needs to be cut to size, wherein the inner contour ($K_{Si}$) and/or the outer contour ($K_{Sa}$) of the edge region ($B_S$) of the shell is/are formed of a first longitudinal edge (L1), a second longitudinal edge (L2), a first transverse edge (Q1) and a second transverse edge (Q2) as well as of the four corner regions (E1, E2, E3, E4), wherein each corner region (E1, E2, E3, E4) connects a longitudinal edge (L1, L2) to a transverse edge (Q1, Q2) and the edge region ($B_S$) of the shell includes a waist (T) located between two of the corner regions at least in the region of a longitudinal edge (L1, L2) and/or a transverse edge (Q1, Q2), wherein the waist is sunken in relation to both of the corner regions it is between, wherein the waist extends across at least 50% to 80% of a maximum length (w1) and/or a maximum width (w2) of the shell.

2. The shell muffler according to claim 1, wherein the shape of the outer contour ($K_{Sa}$) differs from the inner contour ($K_{Si}$).

3. The shell muffler according to claim 1, wherein the inner contour ($K_{Si}$) and/or the outer contour ($K_{Sa}$) of the edge region ($B_S$) of the shell include(s) the waist (T) in the region of both longitudinal edges (L1, L2) and/or in the region of both transverse edges (Q1, Q2).

4. The shell muffler according to claim 3, wherein the shape of the outer contour $K_{Sa}$ differs from the inner contour $K_{Si}$.

5. The shell muffler according to claim 1, wherein the inner contour ($K_{Si}$) and/or the outer contour ($K_{Sa}$) of the edge region ($B_S$) of the shell is/are bone-shaped.

6. The shell muffler according to claim 1, wherein a plurality of the waists (T) are provided, one of said waists being provided between each adjacent pair of the corner regions (E1-E4), and wherein a length of the two longitudinal edges (L1, L2) is smaller than the maximum length (w1) of the shell, and wherein a length of the two transverse edges (Q1, Q2) is smaller than the maximum width (w2) of the shell.

7. The shell muffler according to claim 1, wherein a plurality of the waists are provided, wherein a waist is provided on each of both longitudinal edges as well as both transverse edges.

8. The shell muffler according to claim 7, wherein the shell is narrower in the region of the waist than in the region of each corner at a beginning and an end of the waist.

* * * * *